US008525426B2

(12) United States Patent
Tsai et al.

(10) Patent No.: US 8,525,426 B2
(45) Date of Patent: Sep. 3, 2013

(54) LIGHTING APPARATUS AND CONTROLLING METHOD THEREOF

(75) Inventors: Kun-Nan Tsai, Taipei (TW); Fu-Tien Lee, Taipei County (TW)

(73) Assignee: Welland Industrial Co., Ltd., Taipei Hsien (TW)

( * ) Notice: Subject to any disclaimer, the term of this patent is extended or adjusted under 35 U.S.C. 154(b) by 368 days.

(21) Appl. No.: 12/983,416

(22) Filed: Jan. 3, 2011

(65) Prior Publication Data

US 2012/0169250 A1 Jul. 5, 2012

(51) Int. Cl.
*H05B 37/02* (2006.01)

(52) U.S. Cl.
USPC ..... 315/192; 315/307; 315/308

(58) Field of Classification Search
USPC ..... 315/307, 308, 185 R, 192, 193, 191, 315/291, 246
See application file for complete search history.

(56) References Cited

U.S. PATENT DOCUMENTS 6,057,651 A * 5/2000 Usami ..... 315/291
7,471,287 B2 * 12/2008 Chen et al. ..... 345/212
7,479,743 B2 * 1/2009 Namba et al. ..... 315/307

* cited by examiner

*Primary Examiner* — David H Vu
(74) *Attorney, Agent, or Firm* — Rosenberg, Klein & Lee

(57) ABSTRACT

A lighting apparatus includes a first lighting module, a second lighting module, a rectifier, and a controller. The rectifier is used to rectify the AC power into an input power. The controller is coupled to the rectifier, the first lighting module, and the second lighting module for receiving the input power. When the input power is less than a reference value, the controller controls the first lighting module, the second lighting module, and the rectifier to form a first connection state. When the input power is greater than the reference value, the controller controls the first lighting module, the second lighting module, and the rectifier to form a second connection state. Also, a controlling method of the lighting apparatus is disclosed.

18 Claims, 9 Drawing Sheets

LIGHTING APPARATUS AND CONTROLLING METHOD THEREOF

FIELD OF THE INVENTION

The instant disclosure relates to a lighting apparatus and controlling method thereof; in particular, to a LED lighting apparatus and controlling method thereof.

DESCRIPTION OF RELATED ART

To operate a light emitting diode (LED), an AC power is typically used to drive the LED. As shown in FIG. 1, such powering option directs the AC power into a rectifying circuit BR. After rectification, the current passes through a current limiting resistor R1 to drive a LED array LA. However, if the AC power is unstable, such driving method may cause the following problems.

First, the output power would become unstable. In other words, based on the peak voltage of the AC power, the current passes through the LED array LA would fluctuate. Consequently, the output power of the LED array LA would be unstable and affect the luminous intensity. The instability makes the LED array LA to be more susceptible to damage and less bright.

Secondly, the LEDs would have low light output. For a LED array LA, the value of overall cut-in voltage is usually set near the peak voltage of the AC power. The AC power is represented by a sine wave, where the peak voltage only occurs for a short time in every cycle. Therefore, only a short time is allowed for current flow across the LEDs. Under such condition, the value of peak current must be raised, in order to maintain a fixed value for the average current flowing across the LED array LA. In general, the relationship between the light intensity of the LED and current flow is not linear. For example, if the LED intensity is 1 mcd for a current of 1 amp, when the current is up to 2 amps, the LED intensity is 1.6 mcd instead of 2 mcd. As a result, for the LED array LA, if the value of cut-in voltage is set near the peak voltage of the AC power, when the AC power is unstable, the light output would fluctuate and cause the light output efficiency of the LED array LA to be reduced. The overall system efficiency would be affected accordingly, where the overall system efficiency is defined by multiplying the LED driving efficiency to the LED light output efficiency.

SUMMARY OF THE INVENTION

The instant disclosure provides a lighting apparatus and controlling method thereof. Through an input power derived from the rectification of the AC power, the lighting apparatus changes the connection relationship between the rectifier and at least two lighting modules thereof. The purpose is to enhance the light output efficiency and extend the service life.

According to one embodiment, the lighting apparatus of the instant disclosure receives an alternating current (AC) and comprises a first lighting module, a second lighting module, a rectifier, and a controller. The rectifier converts the AC into an input power. The controller is coupled to the rectifier, the first lighting module, and the second lighting module. The controller receives the input power. When the input power is less than a reference value, the controller controls the first lighting module, the second lighting module, and the rectifier to form a first connection state. Conversely, when the input power is greater than the reference value, the controller controls the first lighting module, the second lighting module, and the rectifier to form a second connection state.

According to another embodiment, the controlling method of the lighting apparatus of the instant disclosure is suitable for a controller of controlling a first lighting module and a second lighting module. The controlling method includes the steps of: obtaining an input power of rectified AC; controlling the first lighting module, the second lighting module, and the rectifier to form a first connection state, when the input power is less than a reference value; and controlling the first lighting module, the second lighting module, and the rectifier to form a second connection state, when the input power is greater than the reference value.

Still according to another embodiment, the controlling method of the lighting apparatus of the instant disclosure is suitable for a controller of controlling a plurality of lighting modules. The controlling method comprises the steps of: obtaining an input power of rectified AC; controlling the plurality of lighting modules and the rectifier to form a first connection state, when the input power is less than a first reference value; controlling the plurality of lighting modules and the rectifier to form a second connection state, when the input power is greater than the first reference value and less than a second reference value; and controlling the plurality of lighting modules and the rectifier to form a third connection state, when the input power is greater than the second reference value.

Based on the above, the embodiments of the instant disclosure use the input power of rectified AC to change the connection relationship between two or more lighting modules and the rectifier. Along with obtaining a fixed average current, the value of peak current flowing across the lighting module can be reduced, thereby increasing the light output efficiency and service life.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

For the lighting apparatus of the present embodiment of the instant disclosure, the driving technique thereof utilizes rectified AC as the input power to drive two or more lighting modules. The lighting module can be a light emitting diode (LED) or a LED array. The LED array includes a plurality of LEDs, which can be wired in series or in parallel, or a combination thereof. However, the LED or the LED array is not the only choice. Any lighting module that can be driven directly by the input power, or rectified AC, is included in the scope of the instant disclosure.

Figure 1:
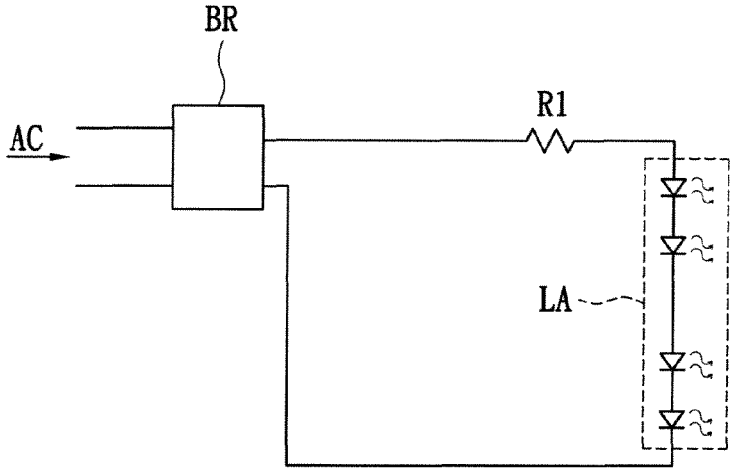
FIG. 1 PRIOR ART
FIG. 1 shows a driving circuitry of a typical light emitting diode (LED).
Figure 2:
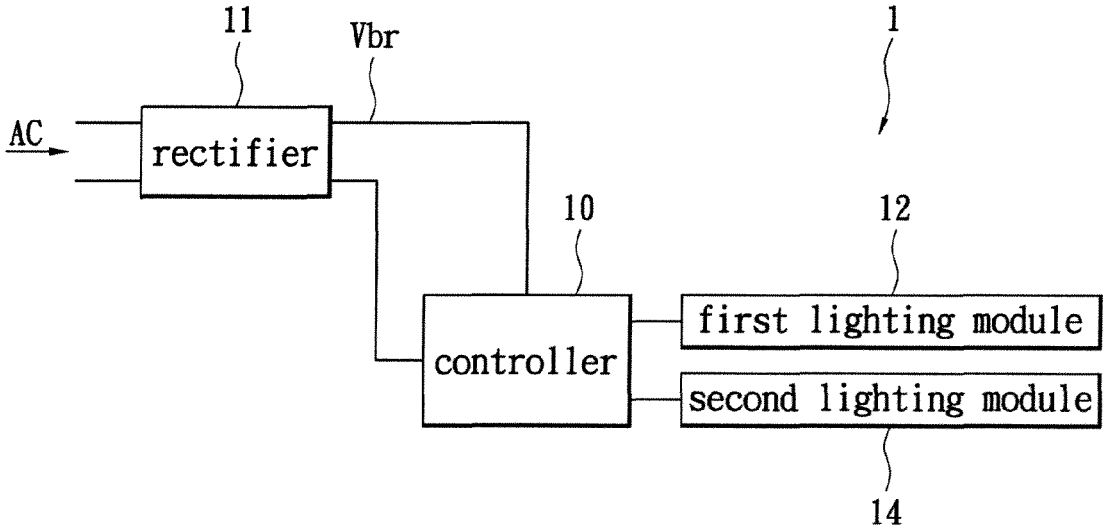
FIG. 2 shows a function block diagram for an embodiment of the instant disclosure.

Please refer to FIG. 2, which shows a function block diagram for the preferred embodiment of the instant disclosure. The lighting apparatus 1 includes a controller 10, a rectifier 11, a first lighting module 12, and a second lighting module 14. The controller 10 is coupled to the rectifier 11, the first lighting module 12, and the second lighting module 14. The rectifier 11 converts an AC into an input power Vbr. The voltage waveform of the input power Vbr is of the rectified AC, where the usual waveform of an AC is a sine wave. Therefore, the voltage magnitude of the input power Vbr changes accordingly with the AC.

Please refer back to FIG. 2. The controller 10 receives the input power Vbr and detects the voltage magnitude thereof. Meanwhile, the controller 10 is encrypted with a reference value. When the voltage of the input power Vbr is less than the reference value, the controller 10 controls the first lighting module 12, the second lighting module 14, and the rectifier 11 to form a first connection state. When the voltage of the input power Vbr is greater than the reference value, the controller 10 controls the first lighting module 12, the second lighting module 14, and the rectifier 11 to form a second connection state.

So, based on the input power Vbr of rectified AC, the lighting apparatus 1 can change the connection state between the first lighting module 12, the second lighting module 14, and the rectifier 11. By obtaining a fixed average current, the value of the peak current of every voltage cycle across the first lighting module and the second lighting module can be reduced. Therefore, a high light output efficiency and long service life can be achieved.

Figure 3:
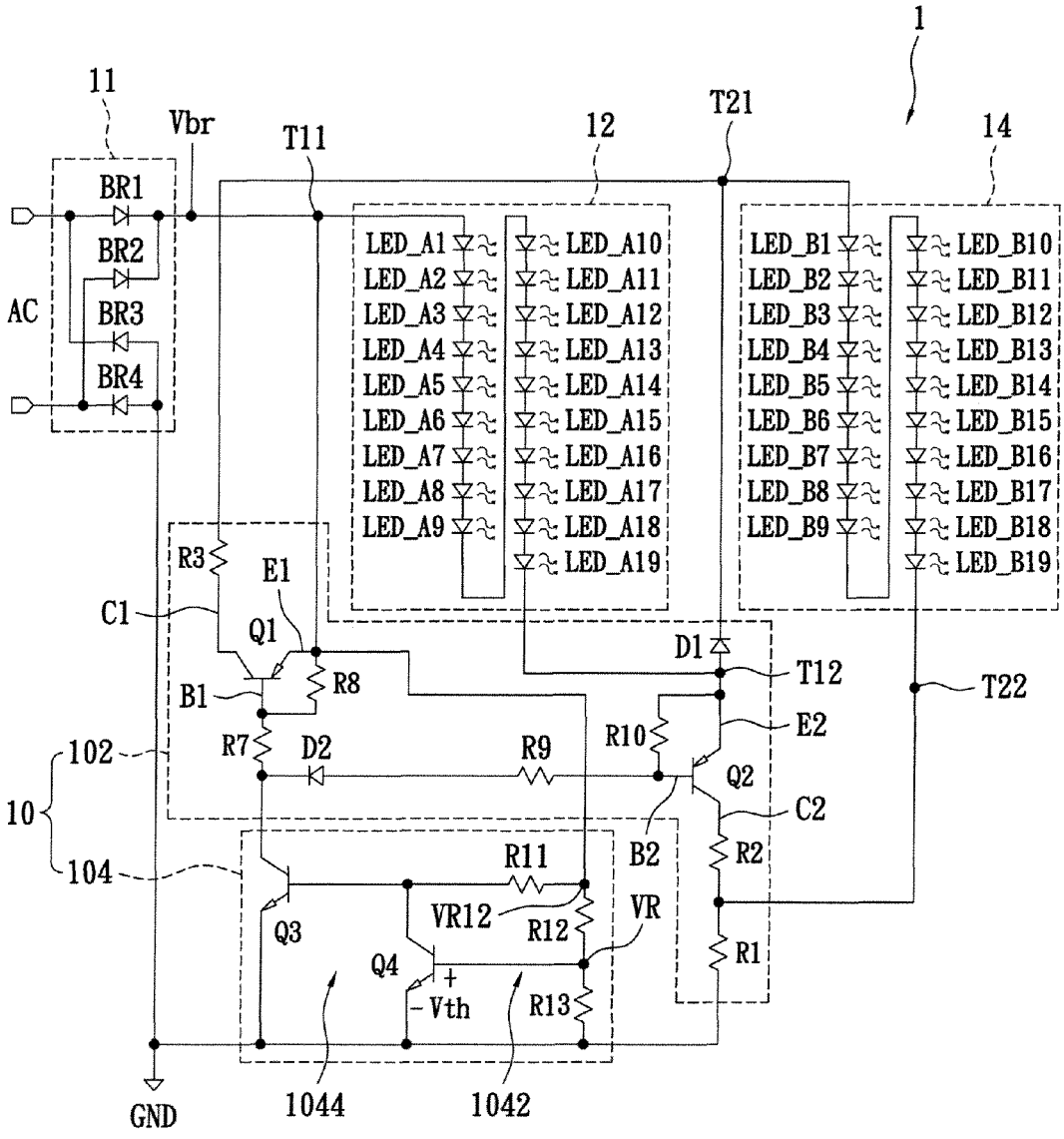
FIG. 3 shows a circuit diagram for the first embodiment of the instant disclosure.

Please refer to FIG. 3. FIG. 3 shows a circuit diagram for a first embodiment of the instant disclosure, based on the previously mentioned function block. The rectifier 11 is a full-wave rectifier used to convert AC into input power Vbr. The rectifier 11 may be made of a rectifier chip or four diodes BR1~BR4. Since the technology is obvious to someone skilled in the art, no further elaborations are given here.

The controller 10 includes a switch 102 and a controlling unit 104. The switch 102 is coupled to the first lighting module 12 and the second lighting module 14. The controlling unit 104 is coupled to the rectifier 11 and the switch 102. By determining whether the voltage of the input power Vbr is greater than the reference value or not, the controlling unit 104 controls the operation of the switch 102 accordingly. The operation of the switch 102 can change the connection relationship between the first lighting module 12, the second lighting module 14, and the rectifier 11. Based on whether the voltage of the input power Vbr is greater than the reference value or not, the connection relationship between the three components is either in the first or second connection state.

Please refer back to FIG. 3. The switch 102 includes a diode D1, a first transistor Q1, and a second transistor Q2. The associated connection relationship and operating schemes are explained below. The anode end of the diode D1 is connected to the output end T12 of the first lighting module 12. The cathode end of the diode D1 is connected to the input end T21 of the second lighting module 14. The input/output end C1 of the first transistor Q1 is connected to the cathode end of the diode D1 via a current limiting resistor R3. The other input/output end E1 of the first transistor Q1 is connected to the input end T11 of the first lighting module 12. The controlling end B1 of the first transistor Q1 is connected to the controlling unit 104. Meanwhile, the input/output end C2 of the second transistor Q2 is connected to the output end T22 of the second lighting module 14 via a current limiting resistor R2. The output end T22 of the second lighting module 14 is connected to the ground Gnd and the rectifier 11 via a current limiting resistor R1. The input/output end E2 of the second transistor Q2 is connected to the anode end of the diode D1, and the controlling end B2 of the transistor Q2 is connected to the controlling unit 104.

The current limiting circuitry of the present embodiment includes the current limiting resistors R1, R2, and R3. However, the illustrated current limiting circuitry is not the only choice. Any circuitry that can control the current flow across the lighting module based on the input power Vbr is included in the scope of the instant disclosure.

Please refer back to FIG. 3. The controlling unit 104 includes a bleeder circuit 1042 and a driver circuit 1044. The bleeder circuit 1042 is connected to the rectifier 11. Based on the input power Vbr, the bleeder circuit 1042 creates an input voltage reference value VR, which is proportional to the input power Vbr. For the instant embodiment, the bleeder circuit 1042 includes resistors R12 and R13. However, the illustrated scheme is not the only choice. Any bleeder circuit that can create an input voltage reference value VR based on the input power Vbr is included in the scope of the instant disclosure.

The driver circuit 1044 is coupled to the bleeder circuit 1042 for receiving the input voltage reference value VR. The driver circuit 1044 is encrypted with a set value Vth. When the input voltage reference value VR is less than the set value Vth, the driver circuit 1044 turns on the first transistor Q1 and the second transistor Q2. Thus, the first lighting module 12, the second lighting module 14, and the rectifier 11 form a first connection state. On the other hand, when the input voltage reference value VR is greater than the set value Vth, the driver circuit 1044 turns off the first transistor Q1 and the second transistor Q2. Thus, the first lighting module 12, the second lighting module 14, and the rectifier 11 form a second connection state.

For the instant embodiment, the driver circuit 1044 comprises two transistors Q3 and Q4. However, the illustrated scheme is not the only choice. Any circuitry that can drive the first transistor Q1 and the second transistor Q2 based on the comparison of the input voltage reference value and the set value is under the scope of the instant disclosure.

Figure 4:
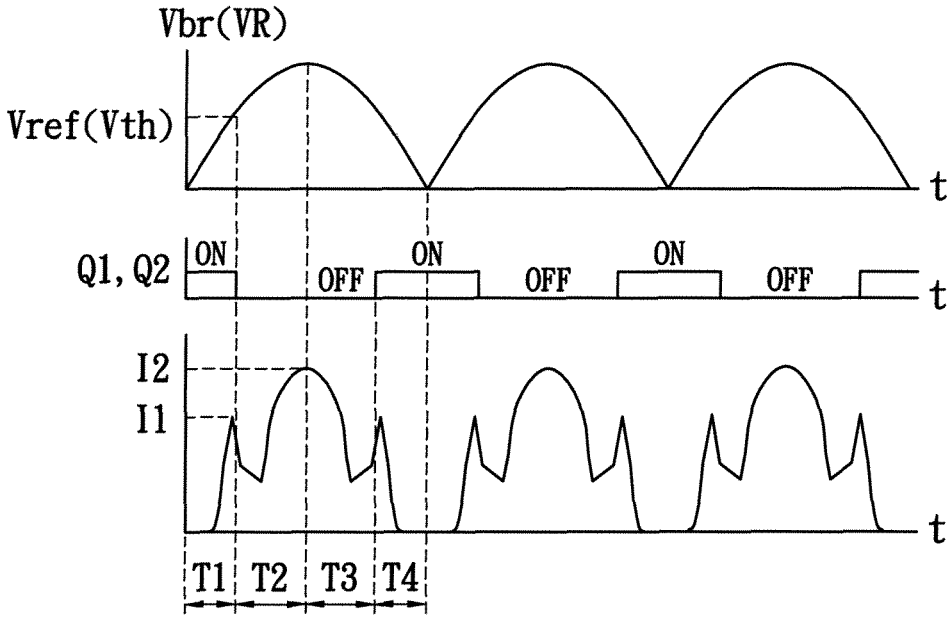
FIG. 4 shows the waveforms of the circuitry shown in FIG. 3.

Please refer to FIGS. 3 and 4. FIG. 4 shows the waveforms of the circuit diagram in FIG. 3. The controlling unit 104 receives the input power Vbr from the rectifier 11, and creates the input voltage reference value VR on the resistor R13 of the bleeder circuit 1042. For the input power Vbr during the time lapse T1, the established input voltage reference value VR on the resistor R13 is less than the set value Vth of the transistor Q4 (meaning the input power Vbr is less than the reference value Vref). For the time interval T1, the resistance voltage VR12 established on the bleeder circuit 1042 would turn on the transistor Q3, thus having the first transistor Q1 and the second transistor Q2 in a turned-on state. In turn, the first lighting module 12 and the second lighting module 14 connected to the rectifier 11 in parallel form the first connection state. Meanwhile, the current I1 flowing across the first lighting module 12 and the second lighting module 14 is shown in FIG. 4.

Yet, for the time lapse T2, as the voltage of the input power Vbr increases, the input voltage reference value VR established on the resistor R13 becomes greater than the set value Vth of the transistor Q4 (meaning the input voltage Vbr is greater than the reference value Vref). For the time interval T2, the transistor Q4 is turned on, and the transistor Q3 is turned off. By being off, the transistor Q3 thus having the first transistor Q1 and the second transistor Q2 in a turned-off state. In turn, the first lighting module 12 and the second lighting module 14 connected to the rectifier 11 in parallel form the second connection state. Meanwhile, the current I2 flowing through the first lighting module 12 and the second lighting module 14 is shown in FIG. 4.

In other words, for the lower input power Vbr, the controlling unit 104 controls the switch 102, in connecting the first lighting module 12 and the second lighting module 14 in parallel. The lower input power Vbr is thus supplied to the first lighting module 12 and the second lighting module 14 in parallel. Since the first lighting module 12 and the second lighting module 14 in parallel have a lower cut-in voltage, therefore, a lower input voltage Vbr is sufficient to create the current flow I1 through the first lighting module 12 and the second lighting module 14. In addition, under the higher input power Vbr, the controlling unit 104 controls the switch 102, in connecting the first lighting module 12 and the second lighting module 14 in series. The higher input power Vbr is thus supplied to the first lighting module 12 and the second lighting module 14 in series. Since the first lighting module 12 and the second lighting module 14 in series have a higher cut-in voltage, therefore, a higher input power Vbr can create a current flow 12 through the first lighting module 12 and the second lighting module 14.

So, by supplying the lower input power Vbr to the first lighting module 12 and the second lighting module 14 in parallel, and supplying the higher input power Vbr to the first lighting module 12 and the second lighting module 14 in series, with obtaining a fixed average current, the peak current value of the voltage through the first lighting module 12 and the second lighting module 14 for every cycle can be reduced. Thus, the goals of high light output efficiency and long service life are achieved.

Please refer back to FIGS. 3 and 4. The input power Vbr (or the input voltage reference value VR) comes from rectified AC having a sine wave. The voltage waveform is symmetrical at 90 degrees. Therefore, for the controlling unit 104 during the time intervals T3 and T4, the controlling operation of the transistors Q3 and Q4 corresponds to T2 and T1 respectively as shown in FIG. 4.

From the above, based on the voltage magnitude of the input power Vbr for every cycle, the controlling unit 104 controls the first lighting module 12, the second lighting module 14, and the rectifier 11 to be in the first connection state, the second connection state, and back to the first connection state. Therefore, driven by a fixed average current, the controlling mode of the controlling unit 104 would reduce the peak current value (such as current I2) for the voltage through the first lighting module 12 and the second lighting module 14 of every cycle. Hence, the light output efficiency and service life are increased for the lighting apparatus 1.

Figure 5:
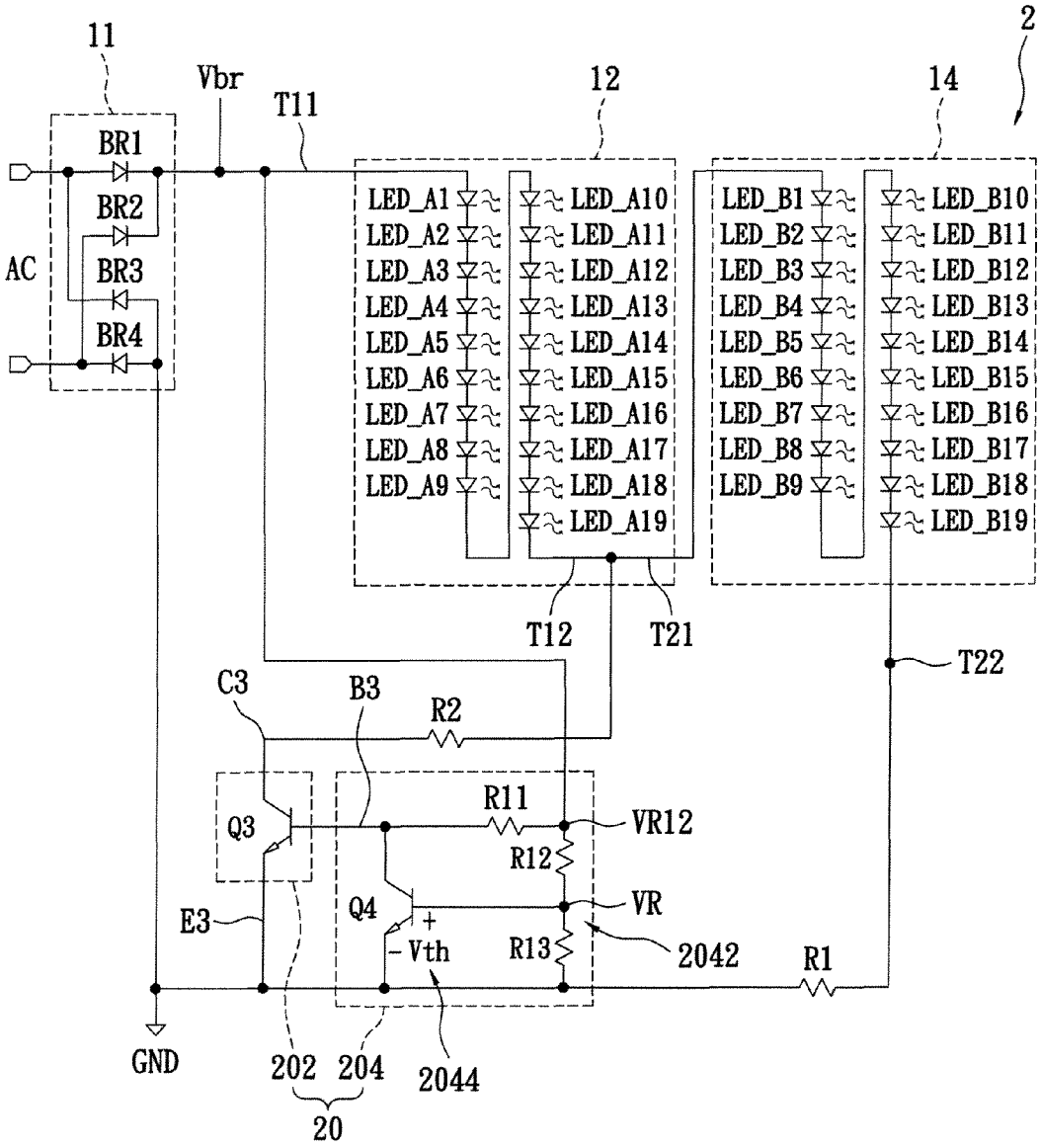
FIG. 5 shows a circuit diagram for the second embodiment of the instant disclosure.

Please refer to FIG. 5, which shows a circuit diagram for a second embodiment of the instant disclosure. The main difference between the lighting apparatus 2 of the instant embodiment and the lighting apparatus 1 in FIG. 3 is the controller 20. The controller 20 of the lighting apparatus 2 includes a switch 202 and a controlling unit 204. The switch 202 is a transistor Q3. The input/output end C3 of the transistor Q3 is connected to the output end T12 of the first lighting module 12 and the input end T21 of the second lighting module 14 via the current-limiting resistor R2. The input/output end E3 of the transistor Q3 is connected to the ground Gnd, and the output end T22 of the second lighting module 14 is connected to the ground Gnd via the current-limiting resistor R1. The controlling end B3 of the transistor Q3 is connected to the controlling unit 204.

Please refer back to FIG. 5. The controlling unit 204 includes a bleeder circuit 2042 and a driver circuit 2044. The bleeder circuit 2042 is the same as the bleeder circuit 1042 in FIG. 3, therefore is not described here again in detail. Meanwhile, the driver circuit 2044 comprises a transistor Q4. Based on the comparison between the input voltage reference value VR and the set value Vth, the driver circuit 2044 drives the transistor Q3. In turn, the first lighting module 12, the second lighting module 14, and the rectifier 11 form the first connection state or the second connection state accordingly.

Hence, the controlling unit 204 receives the input power Vbr from the rectifier 11 and creates the input voltage reference value VR on the resistor R13 of the bleeder circuit 2042. When the input voltage reference value VR is less than the set value Vth of the transistor Q4, the resistance voltage VR12 established on the bleeder circuit 2042 would first turn on the transistor Q3. Thereby, the first lighting module 12 is connected electrically to the rectifier 11 singly, and the second lighting module 14 is cut off from the rectifier 11 in forming a first connection state.

Meanwhile, as the input voltage Vbr increases, the input voltage reference value VR increases accordingly. When the input voltage reference value VR is greater than the set value Vth of the transistor Q4, the transistor Q4 is turned on in turning the transistor Q3 off. Therefore, the first lighting module 12 and the second lighting module 14 are electrically connected to the rectifier 11 in series in forming the second connection state.

In other words, for the lower input power Vbr, the controlling unit 204 controls the switch 202, to have the first lighting module 12 connecting electrically to the rectifier 11 singly. The lower input power Vbr is thus supplied to power the first lighting module 12. By itself, the first lighting module 12 has a lower cut-in voltage. Therefore, a lower input power Vbr is sufficient to operate the first lighting module 12 singly. On the other hand, for the higher input power Vbr, the controlling unit 204 controls the switch 202, to connect the first lighting module 12 with the second lighting module 14 in series, and allowing the higher input power Vbr to power the first lighting module 12 and the second lighting module 14. Since the first lighting module 12 and the second lighting module 14 in series have a higher cut-in voltage, therefore, the higher input power Vbr is able to power the first lighting module 12 and the second lighting module 14.

So, by using the lower input power Vbr to power the first lighting module 12, and using the higher input power Vbr to power the first lighting module 12 and the second lighting module 14 in series, the peak current value for every voltage cycle through the first lighting module 12 and the second lighting module 14 can be reduced. Hence, the higher light output efficiency and the longer service life are achieved.

From the above, based on the voltage magnitude of the input power Vbr for every cycle, the controlling unit 204 controls the first lighting module 12, the second lighting module 14, and the rectifier 11 to be in the first connection state, the second connection state, and back to the first connection state. Therefore, driven by a fixed average current, the controlling mode of the controlling unit 204 would reduce the peak current value for the voltage through the first lighting module 12 and the second lighting module 14 of every cycle. Hence, the light output efficiency and the service life are increased for the lighting apparatus 2.

Figure 6:
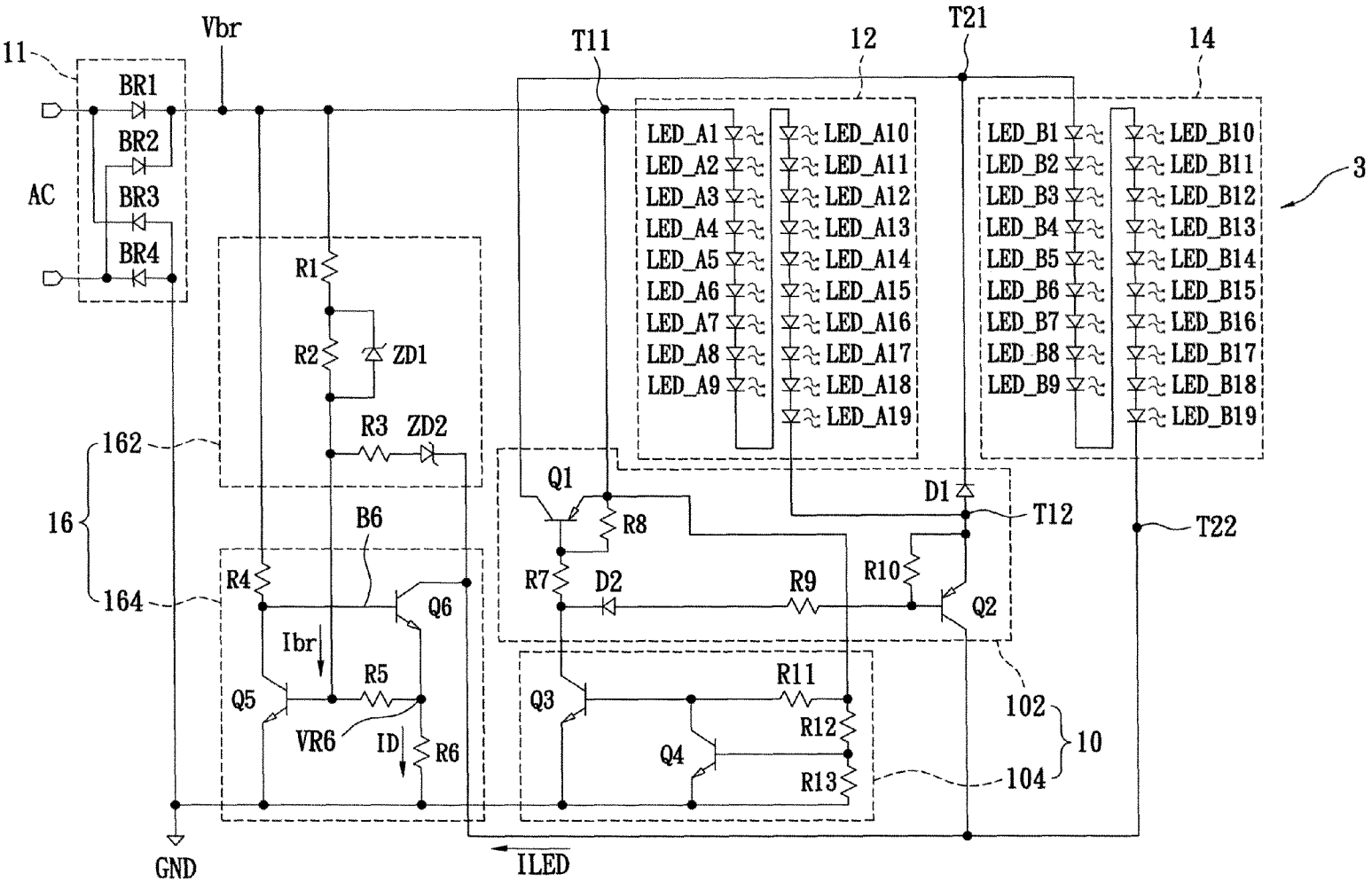
FIG. 6 shows a circuit diagram for the third embodiment of the instant disclosure.

Please refer to FIG. 6 along with FIG. 3. FIG. 6 shows a circuit diagram for a third embodiment of the instant disclosure. The main difference between the lighting apparatus 3 of the instant embodiment and the lighting apparatus 1 in FIG. 3 is that the lighting apparatus 3 further includes a power compensation module 16. The power compensation module 16 is coupled to the rectifier 11, the controller 10, the first lighting module 12, and the second lighting module 14. Based on the voltage magnitude of the input power Vbr, the power compensation module 16 adjusts the main current ILED flowing across the first lighting module 12 and the second lighting module 14. In other words, based on the voltage magnitude of the input power Vbr, the power compensation module 16 compensates the main current ILED flowing across the first lighting module 12 and the second lighting module 14. The purpose is to ensure the input power is within a specified range for a given range of AC.

Figure 7:
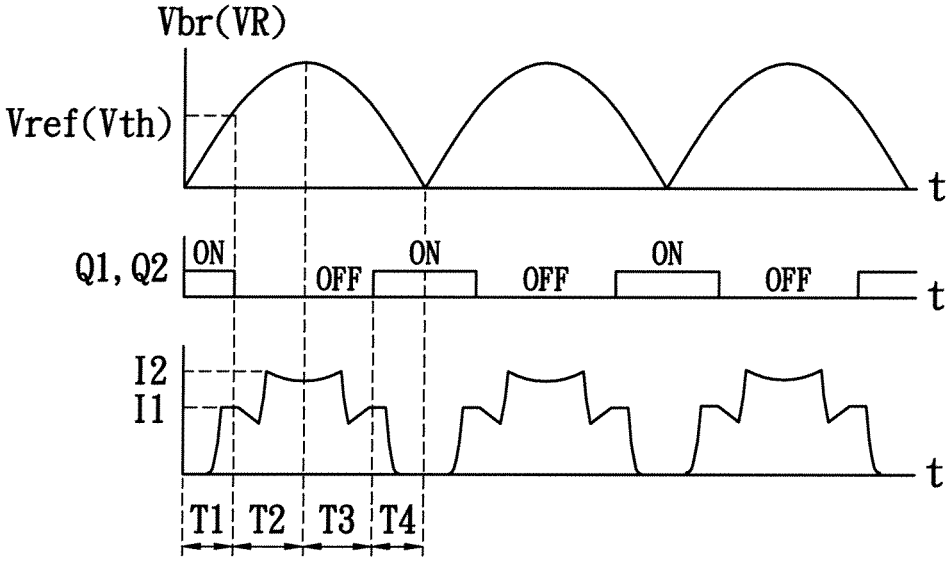
FIG. 7 shows the waveforms of the circuitry shown in FIG. 6.

In the above discussion, the lighting apparatus 3 utilizes the power compensation module 16 for current compensation, which can suppress the peak current flowing across the first lighting module 12 and the second lighting module 14. As shown in FIG. 7, the peak value of the current I1 flowing across the first lighting module 12 and the second lighting module 14 for the time interval T1 is flatter in comparing to FIG. 4. On the other hand, for the time interval T2, the peak value of the current I2 flowing across the first lighting module 12 and the second lighting module 14 is also flatter.

Notably, the power compensation module 16 can couple to the rectifier 11, the first lighting module 12, and the second lighting module 14 in forming a lighting apparatus (not shown) without the controller 10. The power compensation module 16 provides current compensation to the lighting apparatus, for ensuring the input power of the lighting apparatus is within a specified range.

The power compensation module 16 includes a voltage-controlled current source 162 and a constant current source 164. The voltage-controlled current source 162 is coupled to the rectifier 11, and based on the voltage magnitude of the input power Vbr, outputs a compensating current Ibr accordingly. For example, the greater the voltage for the input power Vbr, the output compensating current Ibr is greater also. The less the voltage of the input power Vbr, the output compensating current Ibr is less accordingly. The aforementioned voltage-controlled current source 162 comprises resistors R1 and R2, and a zener diode ZD1. The voltage-controlled current source 162 obtains the voltage of the input power Vbr through the front end input, and based on the voltage magnitude of the input power Vbr, outputs the corresponding compensating current Ibr to compensate the main current ILED.

On the other hand, the constant current source 164 is coupled o the voltage-controlled current source 162, the controller 10, the first lighting module 12, and the second lighting module 14. The constant current source 164 receives the compensating current Ibr from the voltage-controlled current source 162, and based on the magnitude of the compensating current Ibr, adjusts the main current ILED flowing across the first lighting module 12 and the second lighting module 14. For example, the greater the compensating current Ibr, the lesser the main current ILED flowing across the first lighting module 12 and the second lighting module 14. Conversely, the lesser the compensating current Ibr, the greater the main current ILED flowing across the first lighting module 12 and the second lighting module 14.

Based on the above, the power compensation module 16 attains the voltage of the input power Vbr, and based on the voltage magnitude of the input power Vbr, compensates accordingly the main current ILED flowing across the first lighting module 12 and the second lighting module 14. Therefore, the main current ILED is kept within a prescribed range.

So, the lighting apparatus 3 of the instant disclosure utilizes the power compensation module 16 to provide current compensation to the main current ILED. Thus, the main current ILED is kept from being affected negatively by the instability of the input power Vbr, while keeping the input power within a prescribed range. Thus, a solution is provided in resolving the issue of LED damage and light failure due to the instability of the AC.

Please refer back to FIG. 6. The constant current source 164 includes transistors Q5 and Q6 and resistors R4, R5, and R6. The resistor R4 is coupled to the input power Vbr, for providing bias current to the transistor Q5 and driving current to the transistor Q6. The controlling end B6 of the transistor Q6 is controlled by the transistor Q5. The current ID flowing across the resistor R6 is the main current ILED, and the current ID establishes voltage VR6 on the resistor R6, for allowing the transistor Q5 to operate in the active region. Thereby, the transistor Q5 connected to the controlling end B6 of the transistor Q6 is able to be used to adjust the main current ILED flowing across the transistor Q6. Thus, the main current ILED is kept at a fixed current value.

On the other hand, the compensating current Ibr outputted by the voltage-controlled current source 162 flows to the resistor R6 via the resistor R5 of the constant current source 164. When the resistance of the resistor R5 is much greater than the resistance of the resistor R6, the voltage VR6 would form an offset voltage of Ibr×R5. Based on Thevenin's theorem, ID×R6=VR6−Ibr×R5. Therefore, the compensating current Ibr outputted by the voltage-controlled current source 162 provides current compensation to the main current ILED. Based on the voltage magnitude of the input power Vbr, the main current ILED can change accordingly to maintain the input power within a prescribed range. In turn, the issue of LED damage and light failure of the first lighting module 12 and the second lighting module 14 due to the instability of the AC is resolved.

Please refer back to FIG. 6. The voltage-controlled current source 162 can also couple to the output end T12 of the first lighting module 12 and the output end T22 of the second lighting module 14. Based on the voltage difference ΔV between the input power Vbr and first lighting module 12 plus the second lighting module 14, the voltage-controlled current source 162 would output the compensating current Ibr accordingly. The aforementioned voltage-controlled current source 162 includes a resistor R3 and a zener diode ZD2. The voltage-controlled current source 162 attains the voltage difference ΔV through the back end thereof, and outputs the corresponding compensating current Ibr based on the voltage difference ΔV for current compensation of the main current ILED.

For example, when the first lighting module 12 and the second lighting module 14 are connected in parallel, the voltage difference ΔV is approximately equal to the input power Vbr minus the forward biased voltage V1 of the first lighting module 12 or minus the forward biases voltage V2 of the second lighting module 14. Namely, ΔV=Vbr−V1 or ΔV=Vbr−V2. When the first lighting module 12 and the second lighting module 14 are connected in series, the voltage difference ΔV is approximately equal to the input power Vbr minus the forward biased voltage of the first lighting module 12 and the second lighting module 14. Namely, ΔV=Vbr−(V1+V2).

Please refer back to FIG. 6. The aforementioned voltage-controlled current source 162 can also include the resistors R1~R3 and the zener diodes ZD1~ZD2. Based on the front end and back end attaining technique, the voltage-controlled current source 162 outputs the corresponding compensating current Ibr for current compensation of the main current ILED.

Figure 8:
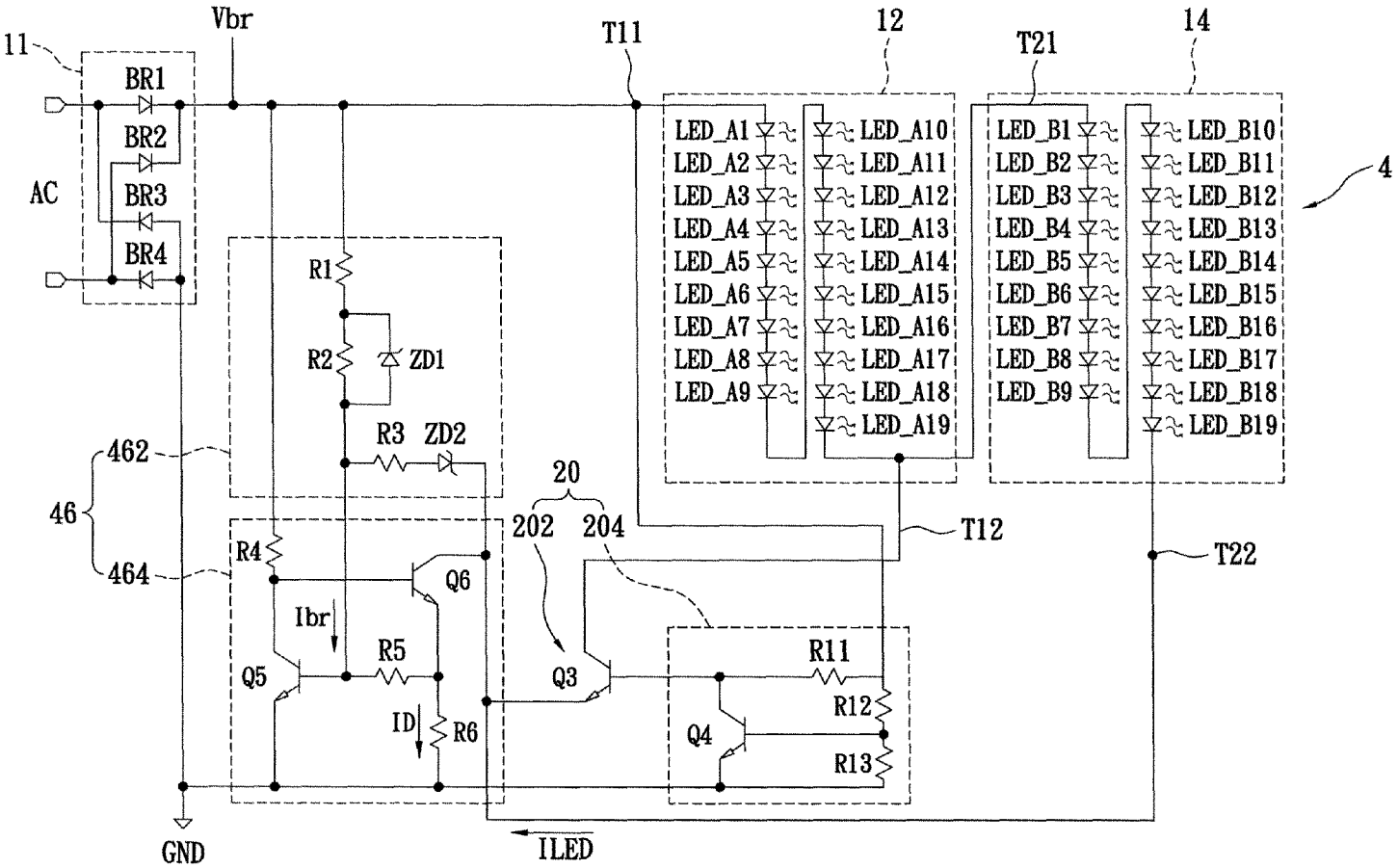
FIG. 8 shows the circuit diagram for the fourth embodiment of the instant disclosure.

Please refer to FIG. 8 in conjunction with FIG. 5. FIG. 8 shows the circuit diagram for a fourth embodiment of the instant disclosure. The main difference between the lighting apparatus 4 of the instant embodiment and the lighting apparatus 2 in FIG. 5 is that the lighting apparatus 4 further includes a power compensation module 46. The power compensation module 46 is coupled to the rectifier 11, the controller 20, the first lighting module 12, and the second lighting module 14. Based on the voltage magnitude of the input power Vbr, the power compensation module 46 adjusts the main current ILED flowing across the first lighting module 12 and the second lighting module 14 accordingly. The description of the power compensation module 46 is the same as the power compensation module 16 shown in FIG. 6, therefore no further elaboration is given here.

Figure 9:
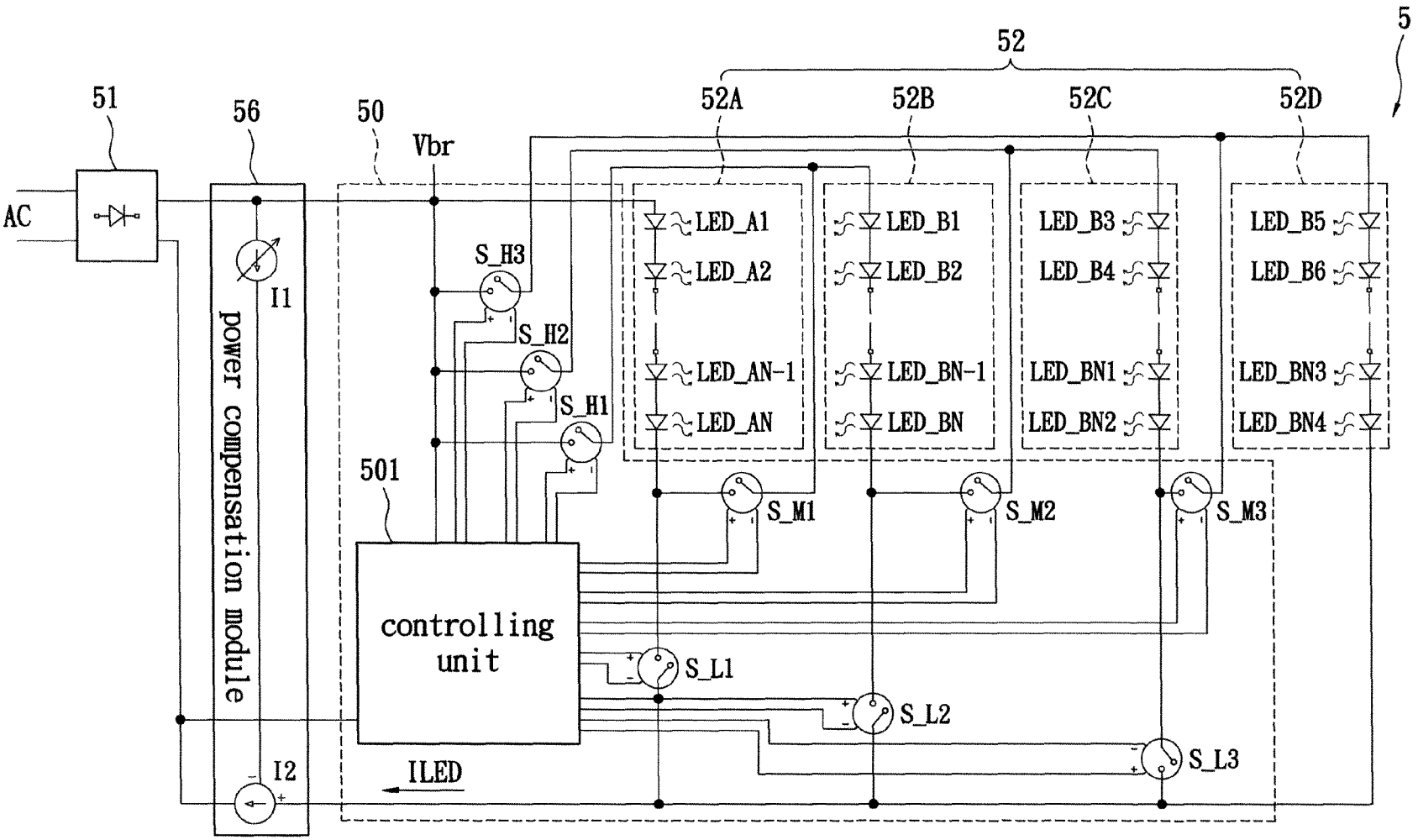
FIG. 9 shows the circuit diagram for the fifth embodiment of the instant disclosure.

Please refer to FIG. 9, which shows the circuit diagram for a fifth embodiment of the instant disclosure. The lighting apparatus 5 includes a controller 50 and a plurality of lighting modules 52. The plurality of lighting modules 52 comprises four lighting modules 52A, 52B, 52C, and 52D, but is not limited thereto. The controller 50 is coupled to the rectifier 51 and the plurality of lighting modules 52, where the controller 50 receives the input power Vbr from the rectifier 51.

Using the input power Vbr of the rectified AC, a controlling unit 501 of the controller 50 controls the switches S_H1~S_H3, S_L1~S_L3, and S_M1~S_M3 accordingly. The goal is to change the connection relationship between the plurality of lighting modules 52 and the rectifier 51. In turn, for every voltage cycle, the value of the peak current flowing across the lighting module 52 can be reduced, to achieve a high light output efficiency and a long service life for the lighting apparatus 5.

Figure 10:
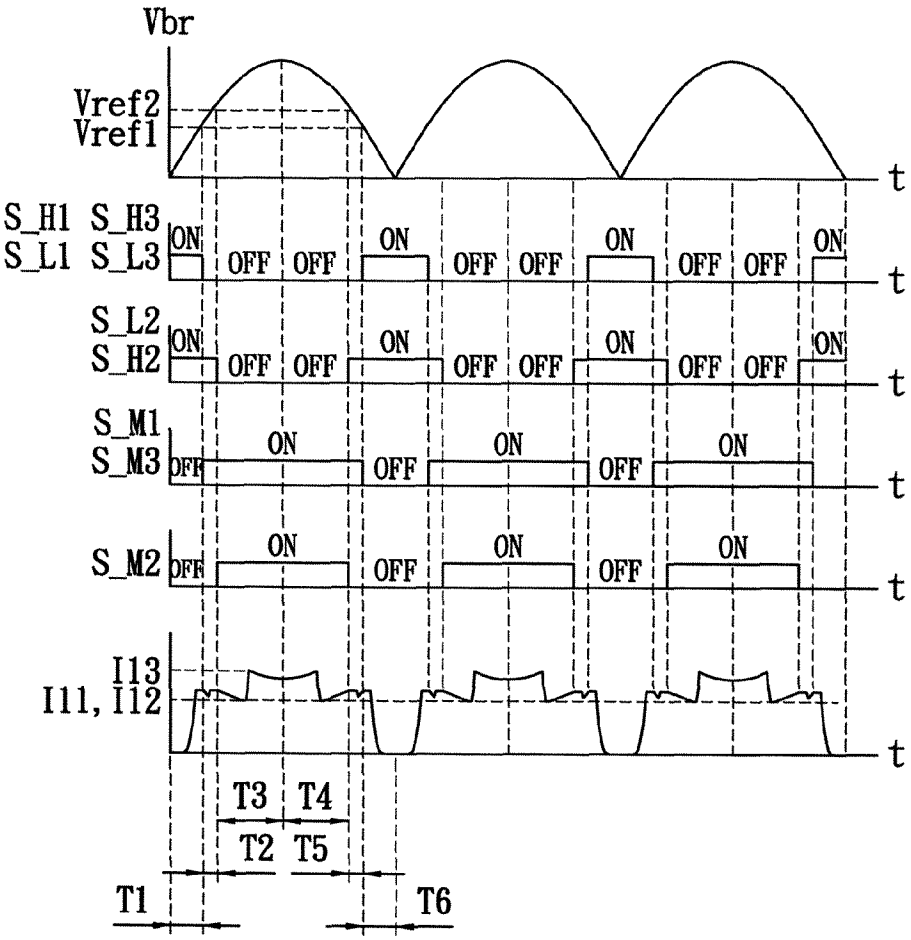
FIG. 10 shows the waveforms for the circuitry shown in FIG. 9.

Please refer to FIGS. 9 and 10. FIG. 10 shows the waveforms for the circuit diagram in FIG. 9. When the input power Vbr is less than a first reference value Vref1 for the time interval T1, the switches S_H1~S_H3, S_L1~S_L3 are turned on while S_M1~S_M3 are turned off inside the controller 50. The configuration allows the lighting modules 52A, 52B, 52C, and 52D to be electrically connected with the rectifier 51 in parallel in forming the first connection state. Meanwhile, the current I11 flowing across the lighting modules 52A, 52B, 52C, and 52D is shown in FIG. 10.

Next, when the input power Vbr is greater than the first reference value Vref1 but less than a second reference value Vref2 for the time interval T2, the switches S_H1, S_H3, $S_L_1$, S_L3, and S_M2 are turned off, while the switches S_H2, S_L2, S_M1, and S_M3 are turned on. The configuration allows the lighting modules 52A and 52B to be electrically connected with the rectifier 51 in series, and the lighting modules 52C and 52D to be electrically connected with the rectifier 51 in series in forming the second connection state.

Meanwhile, the current I12 flowing across the lighting modules 52A, 52B, 52C, and 52D is shown in FIG. 10.

Furthermore, when the input power Vbr is greater than the second reference value Vref2 for the time interval T3, the switches S_H1, S_H3, S_L1, S_L3, S_H2, S_L2 are turned off, and the switches S_M1~S_M3 are turned on within the controller 50. The configuration allows the lighting modules 52A, 52B, 52C, and 52D to connect electrically with the recitifier 51 in series in forming the third connection state. Meanwhile, the current I13 flowing across the lighting modules 52A, 52B, 52C, and 52D is shown in FIG. 10.

Please refer back to FIGS. 9 and 10. The input power Vbr has a sine wave of rectified AC. The voltage waveform is symmetrical at 90 degrees. Therefore, for the time intervals T4, T5, and T6, the controller 50 operations about the switches S_H1~S_H3, S_L1~S_L3, and S_M1~S_M3 correspond to the switch operations during the time intervals T3, T2, and T1 respectively, as shown in FIG. 10.

From the above, based on the voltage magnitude of the input power Vbr, the controller 50 would configure the connection relationship between the lighting modules 52A, 52B, 52C, and 52D with the rectifier 51 in a cycle, namely the first connection state, the second connection state, the third connection state, the second connection state, and the first connection state. Therefore, under the driving mode of fixed mean current, the controlling mode of the controller 50 can reduce the value of peak current for every voltage cycle across the lighting modules 52A, 52B, 52C, and 52D. In turn, the light output efficiency is increased along with longer service life for the lighting apparatus 5.

Please refer to FIG. 9. The lighting apparatus further includes a power compensation module 56. The power compensation module 56 is coupled to the rectifier 51, the controller 50, and the plurality of lighting modules 52. Based on the voltage magnitude of the input power Vbr, the power compensation module 56 adjusts the main current ILED flowing across the plurality of lighting modules accordingly. Since the description of the power compensation module 56 is the same as the power compensation module 16 in FIG. 6, no further details are elaborated here.

For the fifth embodiment of the instant diclosure, as disclosed in FIG. 10 of the switch control sequence, the controller 50 symmetrically controls the connection relationship between the lighting modules 52A, 52B, 52C, and 52D with the rectifier 51. The illustrated control sequence is not the only choice of the control mode. Any circuitry that can control the connection relationship between the lighting modules based on the input power Vbr is covered under the claims of the instant disclosure.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A lighting apparatus of receiving alternating current (AC), comprising:

a first lighting module;

a second lighting module;

a rectifier for converting the AC into an input power; and a controller coupled to the rectifier, the first lighting module, and the second lighting module, the controller being configured to receive the input power, when the input power being less than a reference value, the controller controls the first lighting module, the second lighting module, and the rectifier to form a first connection state, when the input power being greater than the reference value, the controller controls the first lighting module, the second lighting module, and the rectifier to form a second connection state.

2. The lighting apparatus of claim 1, wherein the controller further comprising:

a switch coupled to the first lighting module and the second lighting module; and a controlling unit coupled to the rectifier and the switch, the controlling unit controls the switch to configure the first lighting module, the second lighting module, and the rectifier in forming the first connection state or the second connection state.

3. The lighting apparatus of claim 2, wherein the first connection state is defined by the first lighting module and the second lighting module electrically connected to the rectifier in parallel, and wherein the second connection state is defined by the first lighting module and the second lighting module electrically connected to the rectifier in series.

4. The lighting apparatus of claim 2, wherein the first connection state is defined by the first lighting module connected electrically to the rectifier, with the second lighting module being cut off from the rectifier, and wherein the second connection state is defined by the first lighting module and the second lighting module electrically connected to the rectifier in series.

5. The lighting apparatus of claim 1, wherein the first lighting module and the second lighting module each comprises a light-emitting diode (LED) or a plurality of connected LEDs.

6. The lighting apparatus of claim 1, further comprising a power compensation module, wherein the power compensation module is coupled to the rectifier, the controller, the first lighting module, and the second lighting module, and wherein based on the voltage magnitude of the input power, the power compensation module adjusts the main current flowing across the first lighting module and the second lighting module accordingly.

7. The lighting apparatus of claim 6, wherein the power compensation module further comprising:

a voltage-controlled current source coupled to the rectifier and outputs a compensating current based on the voltage magnitude of the input power; and a constant current source coupled to the voltage-controlled current source, the controller, the first lighting module, and the second lighting module, the constant current source receives the compensating current and adjusts the main current flowing across the first lighting module and the second lighting module based on the compensating current.

8. The lighting apparatus of claim 6, wherein the power compensation module comprising:

a voltage-controlled current source coupled to the respective output end of the first lighting module and the second lighting module, wherein based on the voltage difference between the input power versus the first lighting module and the second lighting module, the voltage-controlled current source outputs a compensating current accordingly; and a constant current source coupled to the voltage-controlled current source, the controller, the first lighting module, and the second lighting module, wherein the constant current source receives the compensating current, and wherein the constant current source adjusts the main current flowing across the first lighting module and the second lighting module based on the compensating current.

9. The lighting apparatus of claim 2, wherein the switch comprising:

a diode having an anode and a cathode, the anode being connected to the output end of the first lighting module, the cathode being connected to the input end of the second lighting module;

a first transistor having a first output/input end, a second output/input end, and a first controlling end, the first output/input end being connected to the cathode of the diode, the second output/input end being connected to the input end of the first lighting module, the first controlling end being connected to the controller; and a second transistor having a third output/input end, a fourth output/input end, and a second controlling end, wherein the third output/input end being connected to the output end of the second lighting module, the ground, and the rectifier, and wherein the fourth output/input end being connected to the anode of the diode, and wherein the second controlling end being connected to the controlling unit.

10. The lighting apparatus of claim 9, wherein the controlling unit comprising:

a bleeder circuit connected to the rectifier, the bleeder circuit establishes a input voltage reference value based on the input power; and a driver circuit coupled to the bleeder circuit, wherein when the input voltage reference value is less than a set value, the driver circuit turns on the first transistor and the second transistor, to control the first lighting module, the second lighting module, and the rectifier in forming the first connection state; when the input voltage reference value is greater than the set value, the driver circuit turns off the first transistor and the second transistor, to control the first lighting module, the second lighting module, and the rectifier in forming the second connection state.

11. The lighting apparatus of claim 10, wherein the first connection state is defined by the first lighting module and the second lighting module electrically connected to the rectifier in parallel, and wherein the second connection state is defined by the first lighting module and the second lighting module electrically connected to the rectifier in series.

12. The lighting apparatus of claim 2, wherein the switch is a transistor having a first output/input end, a second output/input end, and a controlling end, and wherein the first output/input end is connected in between the first lighting module and the second lighting module via a current-limiting resistor, and wherein the second output/input end is connected to the ground, and wherein the controlling end is connected to the controlling unit.

13. The lighting apparatus of claim 12, wherein the controlling unit comprising:

a bleeder circuit connected to the rectifier, the bleeder circuit establishes an input voltage reference value based on the input power; and a driver circuit coupled to the bleeder circuit, wherein when the input voltage reference value is less than a set value, the driver circuit turns on the transistor, to control the first lighting module, the second lighting module, and the rectifier in forming the first connection state; when the input voltage reference value is greater than the set value, the driver circuit turns off the transistor, to control the first lighting module, the second lighting module, and the rectifier in forming the second connection state.

14. The lighting apparatus of claim 13, wherein the first connection state is defined by the first lighting module electrically connected to the input power and the second lighting module being cut off from the rectifier, and wherein the second connection state is defined by the first lighting module and the second lighting module electrically connected to the rectifier in series.

15. A controlling method of the lighting apparatus, for using by a controller to control a first lighting module and a second lighting module, comprising the steps of:

obtaining an input power, wherein the input power is of rectified alternating current (AC);

controlling the first lighting module, the second lighting module, and the input power to form a first connection state, when the input power is less than a reference value; and controlling the first lighting module, the second lighting module, and the input power to form a second connection state, when the input power is greater than the reference value.

16. The controlling method of the lighting apparatus of claim 15, wherein the first connection state is defined by the first lighting module and the second lighting module electrically connected to the input power in parallel, and wherein the second connection state is defined by the first lighting module and the second lighting module electrically connected to the input power in series.

17. The controlling method of the lighting apparatus of claim 15, wherein the first connection state is defined by the first lighting module electrically connected to the input power and the second lighting module being cut off from the input power, and wherein the second connection state is defined by the first lighting module and the second lighting module electrically connected to the input power in series.

18. A controlling method of the lighting apparatus, for using by a controller to control a plurality of lighting modules, comprising the steps of:

obtaining an input power, wherein the input power is of rectified alternating current (AC);

controlling the plurality of lighting modules to form a first connection state, when the input power is less than a first reference value;

controlling the plurality of lighting modules to form a second connection state, when the input power is greater than the first reference value but less than a second reference value; and controlling the plurality of lighting modules to form a third connection state, when the input power is greater than the second reference value.

* * * * *